US007264087B2

(12) United States Patent
Hawkins

(10) Patent No.: US 7,264,087 B2
(45) Date of Patent: Sep. 4, 2007

(54) CONTROL OF A COUNTERWEIGHTLESS ELEVATOR USING TOTAL MASS OF THE ELEVATOR

(75) Inventor: Giovanni Hawkins, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/298,710

(22) Filed: Dec. 12, 2005

(65) Prior Publication Data

US 2006/0131109 A1 Jun. 22, 2006

Related U.S. Application Data

(63) Continuation of application No. PCT/FI03/00552, filed on Jul. 9, 2003.

(51) Int. Cl.
*B66B 1/28* (2006.01)

(52) U.S. Cl. ..... 187/293; 187/281

(58) Field of Classification Search ..... 187/391–393, 187/276, 277, 281, 293, 296, 297, 289
See application file for complete search history.

(56) References Cited

U.S. PATENT DOCUMENTS 4,751,984 A * 6/1988 Williams et al. ..... 187/293
5,241,141 A 8/1993 Cominelli
5,723,968 A * 3/1998 Sakurai ..... 318/802
5,780,786 A 7/1998 Miyanishi
5,984,052 A 11/1999 Cloux et al.
7,011,184 B2 * 3/2006 Smith et al. ..... 187/281
2004/0089502 A1 * 5/2004 Martini ..... 187/290

OTHER PUBLICATIONS

Patent Abstracts of Japan, vol. 1996, No. 05, May 31, 1996 & JP 08-012206-A, Jan. 16, 1996.

* cited by examiner

*Primary Examiner*—Jonathan Salata
(74) *Attorney, Agent, or Firm*—Birch, Stewart, Kolasch & Birch, LLP

(57) ABSTRACT

Method and system of controlling a counterweightless elevator system provided with an elevator car and a variable speed drive with an electric motor. The elevator car load is weighed, and the elevator system is controlled in order to reduce the physical/electrical dimensions of the system. The total mass of the elevator is defined by the equation Mtotal=Mcar (mass of the car)+A*Maxpayload, wherein Mcar is the mass of the car, A is a coefficient and Maxpayload is the maximal payload. If the payload supercedes A*Maxpayload the elevator is controlled so that the speed and/or acceleration of the motor is reduced, and/or the idle time of the elevator is increased.

10 Claims, 2 Drawing Sheets

CONTROL OF A COUNTERWEIGHTLESS ELEVATOR USING TOTAL MASS OF THE ELEVATOR

FIELD OF THE INVENTION

The present invention relates to a control method and control system for controlling an elevator, especially a variable speed low weight counterweightless elevator.

DESCRIPTION OF THE BACKGROUND OF THE INVENTION

In many residential applications elevator cars and their hoisting systems are dimensioned far (a) maximum planned traffic capacity or maximum number of persons, (b) size of floor area to satisfy occasional large furniture removal and/or wheelchair access. Particularly in counterweightless or counterweightfree elevators, that is mainly hydraulic elevators and drum elevators, this leads to bulky motors and large fuses which can cause a lot of problems, especially when installing new elevators in older buildings or modernizing or upgrading old elevators. Naturally bulgy motors and large fuses and associated high current electric cables also cause higher costs.

However, in majority of trips the elevator carries typically less than 30% of the rated load. Approximately half of the trips, there are no persons in the elevator car (see FIG. 1 a hypothetical usage curve of a counterweightless elevator).

In the traction sheave elevators., the counterweight is generally dimensioned on the weight of the car and half the payload. This means that energy corresponding to the weight of the car is saved, both when the car is traveling full and empty. However on empty down trips, which is common in residential elevators, the hoisting system requires its maximum power, as it has to be able to lift the net difference between the counterweight and the unloaded car. This leads to unnecessary energy consumption. U.S. Pat. No. 5,984,052 discloses a counterweight elevator system which includes a control system that determines the amount of load of the car, and that determines the operating speed profile of the car based upon the amount of load in the car. In a particular embodiment, the control system includes a load weighing device and uses the weight of the car to determine the selection between two operating speed profiles: a normal operating speed profile and a reduced operating speed profile. The control system compares the measured live load to a pre-selected threshold, such as the car weight plus twice the percentage balancing multiplied by the rated full load of the elevator system. If this threshold is exceeded, then the reduced operating speed profile is selected. In this way, reduced balancing may be used. The selected percentage balancing may be determined empirically or estimated by taking into account the building size, usage and other operational characteristics. Thus, in U.S. Pat. No. 5,984,052 energy can be saved by dimensioning the counterweight based on less than half the payload and by reducing the speed of the hoisting system when the car is loaded closer to full capacity. This kind of a reduced counterweight system is difficult to realize in practice.

In many cases the counterweightless hydraulic or drum driven or screw driven or chain driven elevators are used because they offer certain advantages for example with respect to shaft space efficiency. A prior art solution to reduce the hoisting motor size in counterweightless elevators is to dimension the motor smaller than normally by a certain factor and limit the starts per hour. However, this means that the motor still needs to be dimensioned at approximately 70% of full capacity. On empty up trips this means that the motor consumes energy to carry the weight of the car and almost the full payload.

BRIEF SUMMARY OF THE INVENTION

One object of the present invention is to eliminate the drawbacks of prior-art solutions and to achieve a system that would allow that the elevator hoisting systems in counterweightless elevators to be dimensioned smaller than in prior art solutions. An additional object is to provide an economically dimensioned counterweightless traction sheave elevator. Further objects are indicated explicitly or implicitly in ibis specification. One can say tat one of the tasks of the invention is to enable underdimensioning of the machine and electric drive and possibly other components without compromising car size and capacity too much.

The present invention is based on the idea wherein a variable speed hoisting system is combined to a counterweightless elevator with a low weight car. The inventive content may also consist of several separate inventions, especially if the invention is considered in the light of explicitly expressed or implicit sub-tasks or from the point of view of advantages or categories of advantages achieved.

The advantageous combination of a low weight car, load weighing device or other means to estimate the elevator's current load, variable speed hoist and an optional regenerating system will enable (1) significant reduction in hoisting motor and drive size and cost, (2) smaller fuses, (3) significant improvements in energy consumption; with an optional regenerative system some energy produced on down trips may be saved and fed back to the electricity supply system; the use of a variable speed hoisting system combined with a counterweightless elevator allows that the system is tuned for any payload on every trip. The prior art system elevators, e.g. in U.S. Pat. No. 5,984,052, have fixed counterweights and therefore the majority of trips will use some fixed balancing system. This means that for all empty down trips the motor still uses energy to lift the counterweight.

Further scone of applicability of the present invention will become apparent from the detailed description given hereinafter. However, it should be understood that the detailed description and specific examples, while indicating preferred embodiments of die invention, are given by way of illustration only, since various changes and modifications within the spirit and scope of the invention will become apparent to those skilled in the art from this detailed

BRIEF DESCRIPTION OF THE DRAWINGS

In the following, a preferred embodiment of the present invention will be described in detail by reference to the accompanying drawings, which are given by way of illustration only, and thus are not limitative of the present invention, and wherein.

DETAILED DESCRIPTION OF THE INVENTION

Figure 1:
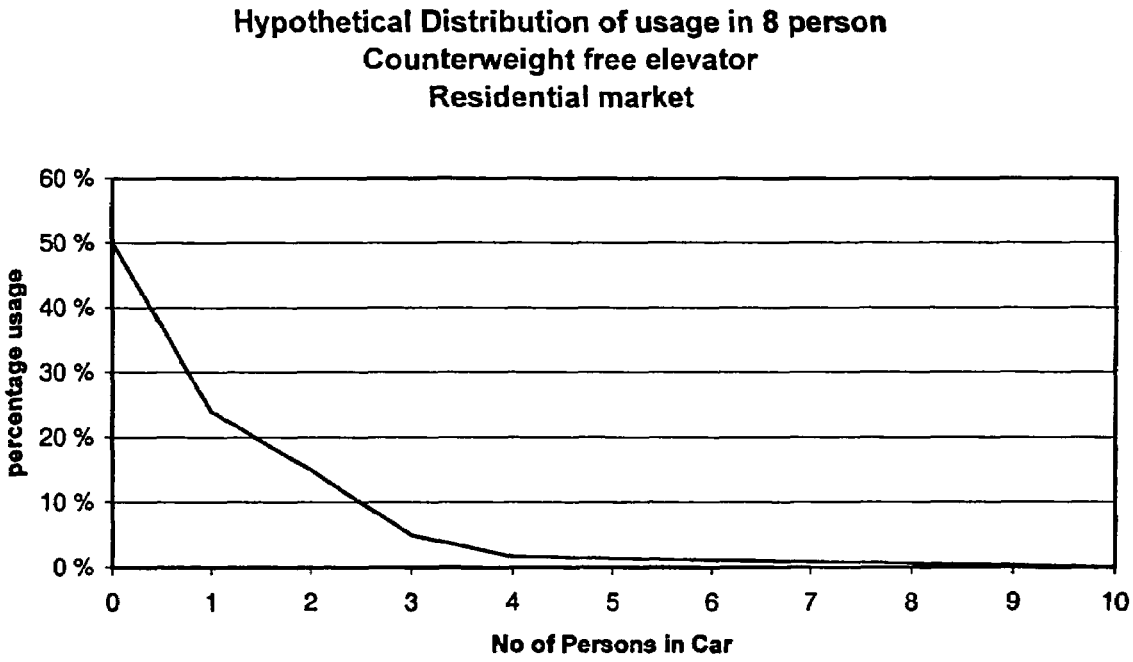
FIG. 1 presents a hypothetical usage curve of a counterweightless elevator.
Figure 2:
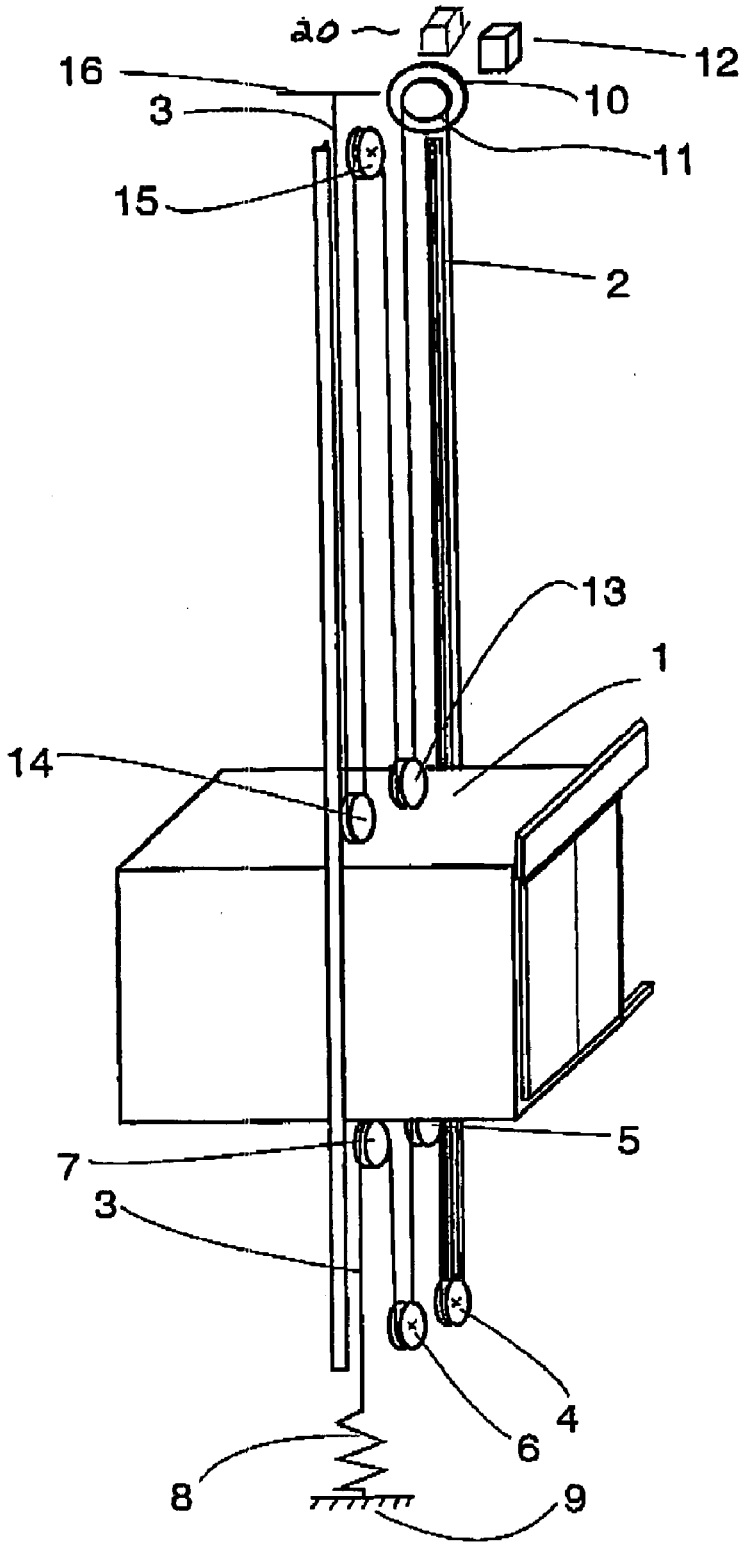
FIG. 2 presents a counterweightless traction sheave elevator.

The counterweightless elevator may be a counterweightless traction sheave elevator according to FIG. 2. FIG. 2 illustrates a counterweightless traction sheave elevator comprising an elevator car 1 and a hoisting device with a variable speed motor drive (e.g. frequency converter 12 and an AC motor 10), the traction sheave 11, diverting pulleys 4, 6, 15 and hoisting ropes 3.

The elevator in FIG. 2 is an elevator without machine room, in which the drive machine 10 is placed in the elevator shaft. The elevator shown in the figure is a traction sheave elevator with machine above. The passage of the hoisting ropes 3 of the elevator is as follows: One end of the ropes is immovably fixed to an anchorage 16 located in the upper part of the shaft. From the anchorage, the ropes run downward and are passed around a diverting pulley 14 on the car roof, from which the ropes 3 run further upward to a second diverting pulley 15 and back to a third diverting pulley 13 on the car roof. Therefrom the ropes run further upward to the traction sheave 11 of the drive machine 10, passing around the traction sheave along rope grooves on the sheave. From the traction sheave 11, the ropes 3 run further downward to the elevator car 1 moving along car guide rails 2, passing under the car via a fourth diverting pulley 4 under the rail 2, and going then upward again to a fifth diverting pulley 5 under the elevator car, again downwards to a sixth diverting pulley 6, an again up to a seventh diverting pulley 7 under the car. From this pulley 7 the ropes are further anchored to the shaft floor 9 with a spring 8 tightening the ropes against the traction sheave and diverting pulleys.

The rope suspension acts in a substantially centric manner on the elevator car 1, provided that the rope pulleys supporting the elevator car are mounted substantially symmetrically relative to the vertical centerline passing via the center of gravity of the elevator car. 1.

The drive machine 10 placed in the elevator shaft is preferably of a flat construction, in other words, the machine has a small depth as compared with its width and/or height, or at least the machine is slim enough to be accommodated between the elevator car and a wall of the elevator shaft. The machine may also be placed differently, e.g. by disposing the slim machine partly or completely between an assumed extension of the elevator car and a shaft wall. A different rope pulley position may be used for traction sheave. Easily such different position can be arranged by having instead pulley 11 as the pulley that transmits the traction to the rope another pulley as a fraction sheave. Naturally the drive machine is in such case associated with this another pulley. In light of die machine dimensioning preferable are the pulley positions with highest rape speeds i.e. positions pulleys 11 and 4. By increasing number of pulleys and rope stretches to the rigging above and below the elevator car the motor speed with respect to the elevator car speed can be increased and thus the motor torque requirement and size can be reduced correspondingly. For example, an traction sheave elevator according to the invention can be implemented using above and below the elevator car suspension ratio of 6:1, 7:1, 8:1, 9:1, 10:1 or even higher suspension ratios. By increasing the contact angle using a diverting pulley, the grip between the traction sheave and the hoisting ropes can be improved. Therefore, it is possible to reduce the weight of the car mid counterweight and their size can be reduced as well, thus increasing the space saving potential of the elevator. Alternatively or at the same time, it is possible to reduce the weight of the elevator car in relation to the weight of the counterweight. A contact angle of over 180° between the traction sheave and the hoisting rope is achieved by using one or more auxiliary diverting pulleys. The elevator shaft can be provided with equipment required for the supply of power to the motor driving the traction sheave 11 as well as equipment for elevator control, including an optional regenerative system 20 both of which can be placed in a common instrument panel 12 or mounted separately from each other or integrated partly or wholly with the drive machine 10.

The drive machine may be of a geared or gearless type. A preferable solution is a geared machine. The drive machine may be fixed to a wall of the elevator shaft, to the ceiling, to a guide rail or guide rails or to some other structure, such as a beam or frame.

In the case of an elevator with machine below, a further possibility is to mount the machine on the bottom of the elevator shaft.

The system further includes load weighing means in the car 1 and a control unit controlling the operation of the elevator system. The car has lower total weight than generally, and especially much lower weight than a corresponding counterweight elevator would have. The speed drive is a variable speed drive. The variable speed hoisting system is dimensioned by power Pnom and torque Tnom, where $$Pnom = Mtotal * V \quad (1)$$

where V=speed and Mtotal=Mcar (mass of the car)+A*Maxpayload, and Tnom is defined by Mtotal, acceleration etc.

A is a coefficient formed for example by the reduction of the speed and acceleration of the motor, the increase in the idle time of the elevator etc., having values 0-0.5, defined experimentally by user studies.

If the payload supersedes A*Maxpayload:

1) the speed and/or acceleration of the motor is reduced accordingly
2) the idle time of the elevator is increased (e.g. by increasing the door opening and closing times)

so that the motor is allowed to cool for an enough long period to avoid thermal overloading.

Further, on empty trips the elevator could be slowed down significantly if the waiting time is acceptable for the residents, thus further saving energy.

It is obvious to the person skilled in the art that the embodiments of the invention are not restricted to the examples presented above, but that they can be varied within the scope of the following claims. Particularly in the case of an elevator with machine below, a further possibility is to use a drum elevator, whereby the car is suspended with hoisting ropes wound on a drum in the hoisting machinery. Elevator with chain drive and suspension system is also suitable to apply the invention. The load weighing device or other means to estimate the elevator's load can be associated with elevator car or with ropes or the hoisting machine or other suitable elevator component or drive motor or other component of elevator can be used to measure the load of elevator car or other respective load information.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. Method of controlling a counterweightless elevator system provided with an elevator car and a variable speed drive with an electric motor, wherein the elevator car load is weighed, and wherein the elevator system is controlled in order to reduce the physical/electrical dimensions of the system, the method defining the total mass of the elevator by an equation Mtotal=Mcar (mass of the car)+A*Maxpayload, wherein Mcar is the mass of the car, A is a coefficient and Maxpayload is the maximal payload, and that if the payload fails to supercede A*Maxpayload, controlling the elevator to have a predetermined idle time of the elevator and a predetermined speed and a predetermined acceleration of the motor; and if the payload supercedes A*Maxpayload, controlling the elevator so that at least one of the idle time of the elevator is increased, and at least one of the speed and acceleration of the motor is reduced.

2. The method as defined in claim 1, wherein that A is a coefficient formed by means of one or several operational characteristics, such as the reduction of the speed and acceleration of the motor, the increase in the idle time of the elevator.

3. The method as defined in claim 1 or 2, wherein A is a coefficient having values 0-0.5.

4. System of controlling a counterweightless elevator system provided with a control unit, an elevator car and a variable speed drive with an electric motor, the system comprising: means for weighing the load of the car, the control unit defines the total mass of the elevator by an equation Mtotal=Mcar (mass of the car)+A*Maxpayload, wherein Mcar is the mass of the car, A is a coefficient and Maxpayload is the maximal payload, and that if the payload fails to supercede A*Maxpayload, the elevator is controlled to have a predetermined idle time of the elevator and a predetermined speed and a predetermined acceleration of the motor; and if the payload supercedes A*Maxpayload the elevator is controlled so that at least one of the idle time of the elevator is increased, and at least one of the speed and acceleration of the motor is reduced.

5. The system as defined in claim 4, wherein the system is provided with a regenerative system in order to utilize energy on down travel.

6. The system as defined in claim 4, wherein the elevator car has essentially lower weight than a corresponding counterweight elevator car.

7. The system as defined in claim 4, wherein the elevator is a counterweightless traction sheave elevator.

8. The system as defined in claim 4, wherein the elevator is a counterweightless drum elevator.

9. The system as defined in claim 4, wherein the elevator is a counterweightless hydraulic elevator.

10. The system as defined in claim 4, wherein the elevator is a counterweightless chain driven elevator.

* * * * *